United States Patent [19]

Dike et al.

[11] 3,932,717

[45] Jan. 13, 1976

[54] HIGH-EXPLOSIVE DRIVEN CROWBAR SWITCH

[75] Inventors: Robert S. Dike; Ralph W. Kewish, Jr., both of Los Alamos, N. Mex.

[73] Assignee: The United States of America as represented by the United States Energy Research and Development Administration, Washington, D.C.

[22] Filed: Oct. 30, 1974

[21] Appl. No.: 519,325

[52] U.S. Cl. ..... 200/61.08
[51] Int. Cl.[2] ..... H01H 39/00
[58] Field of Search ..... 200/61.08

[56] References Cited

UNITED STATES PATENTS

| | | | |
|---|---|---|---|
| 2,929,892 | 3/1960 | Blomgren | 200/61.08 X |
| 3,077,527 | 2/1963 | Goldbach et al. | 200/61.08 X |
| 3,117,194 | 1/1964 | Stresau, Jr. | 200/61.08 |
| 3,238,321 | 1/1966 | Lawwill et al. | 200/61.08 |
| 3,260,810 | 7/1966 | Alston et al. | 200/61.08 |
| 3,269,987 | 8/1966 | Alston et al. | 200/61.08 |
| 3,641,289 | 2/1972 | Dokopoulos | 200/61.08 |

*Primary Examiner*—James R. Scott
*Attorney, Agent, or Firm*—Dean E. Carlson; Paul D. Gaetjens

[57] ABSTRACT

The disclosure relates to a compact explosive driven switch for use as a low resistance, low inductance crowbar switch. A high-explosive charge extrudes a deformable conductive metallic plate through a polyethylene insulating layer to achieve a hard current contact with a supportive annular conductor.

2 Claims, 3 Drawing Figures

Before detonation

After detonation

HIGH-EXPLOSIVE DRIVEN CROWBAR SWITCH

The invention described herein was made in the course of, or under, a contract with the U.S. Atomic Energy Commission.

FIELD OF THE INVENTION

The invention relates to electrical switches and more particularly to high-explosive driven crowbar switches.

BACKGROUND OF THE INVENTION

In certain apparatus, such as in "Toroidal Z-Pinch" devices, it is essential to have a fast-acting, low-inductance, metal-to-metal crowbar type switch. Frequently, there is a minimum amount of space available for such switches because of space availability within the machine into which such a switch must be fitted. Consequently, there is a need for small switches which are self contained and in fact, quite dissimilar to the exploding foil switches of the prior art. A typical prior art foil switch is shown in D. L. Call, "Engineering Problems of Fusion Research," Los Alamos Scientific Laboratory Report, LA4250 (1969), a copy of which is attached hereto. The foil switches, while at times being desirable, require large and elaborate clamping mechanisms as well as complex individual capacitance discharge systems. Their use is frequently restricted by their environmental requirements, making their use impractical in many situations. A high-explosive driven crowbar switch seems to supply the answer to these problems.

SUMMARY OF THE INVENTION

The invention relates to a low inductive explosive-driven crowbar switch comprising a deformable conductive electrode at a first potential, a supportive conductive electrode at a second potential, an insulating layer between the deformable conductive electrode and the supportive electrode, and an explosive device or detonator for selectively deforming the deformable conductor and forcing it through the insulating layer into electrical contact with the supportive electrical conductor. In a preferred embodiment, there is an annular anvil which provides support at an appropriate place and acts as an anvil for stopping the deformable material from being driven any further by the explosive charge as well. The anvil also provides an initial electrical arc contact which is followed by contact with the deformable conductive material. Also in the preferred embodiment, a high-explosive detonator, used as a shaped charge, and an especially shaped breech cause the force of the gas pressure of the charge to be directional in nature to selectively deform a selected portion of the deformable conductive material. In a preferred embodiment, the shaped charge provides annular gas pressure on the deformable material to force it into contact with an annular supportive conductive terminal and the annular anvil.

One object of the present invention is to achieve electrical contact in a minimal amount of time.

Another object of the present invention is to provide a high-explosive driven crowbar switch wherein weight and type of high-explosive charge can be varied to provide a wide range of explosive characteristics to enable switch contact time to be varied and to allow the switch to be used in a variety of environments.

One advantage of the instant invention is that the device thereof is of low inductance, fast, very simple in nature and easy to use.

A second advantage of the instant invention is that the device thereof is economical, reliable, of small size, and usable in a variety of environments.

Other objects and advantages of the instant invention will be apparent to those skilled in the art from the following description with reference to the accompanying drawings wherein like numbers denote like parts and wherein.

DESCRIPTION OF THE PREFERRED EMBODIMENT OF THE INVENTION

As a preferred embodiment, a compact explosively driven, metal-to-metal contact, solid dielectric switch was developed for use as a low resistance, less than 10 microhms ($\mu\Omega$), low inductance, less than 10 nanohenries (nH), crowbar switch. A 100 milligram (mg) high-explosive charge extruded a 0.090-inch (in.) plate through 0.040 in. polyethylene to achieve a hard current contact with a 0.625 in. diameter die plate. Closure time, from the signal which initiated the charge to the beginning current rise in the switch was 11.0 microseconds ($\mu$sec) $\pm$ 0.3 $\mu$sec. In crowbar application the switch carried 180–330 kiloamps (kA) which decayed with a $1/e$ time of approximately 1.2 milliseconds (msec). The basic action of a switch of this type, whether foil or detonator, involves the deformation of metal. It will be noted that the prior art foil switch above mentioned uses expanding gases not unlike a powder discharge to perform its function. In this sense the two switching actions, i.e., that of the prior art foil switch and that of the switch of the instant invention, are similar. Deformation must be accomplished using the extremely sophisticated art of explosive metal forming. The typical explosive system utilizes an explosive charge, an energy transmittal medium, a die plate, and a work piece. In the preferred embodiment of the invention, the explosive charge may be a type RP-2 detonator manufactured by Reynolds Industries of California. Such a detonator is of the subminiature variety, 0.200 in. in diameter and approximately 0.450 in. long. There are two charges in this unit. The first charge is a low density PETN located adjacent to the gold bridge wire initiator which is an extremely fast burning charge. This fast burning charge ignites a second high density charge of tetryl which acts as a high energy booster. The manufacturer of these detonators provides a rigidly controlled crystallization process for both the explosive and the loading operations; charge density is well controlled. The resulting detonator provides a transmission time simultaneity of $\pm$ 25 nanoseconds (nsec). The energy transfer medium not only transmits a fast uniform shock wave, but also acts as an efficiency coupling agent. Although the most efficient material for such purposes would be an incompressible liquid such as water or oil, these materials are frequently difficult to contain. Hence, in accordance with the preferred embodiment of the invention, the agent used comprises paraffin.

Figure 1:
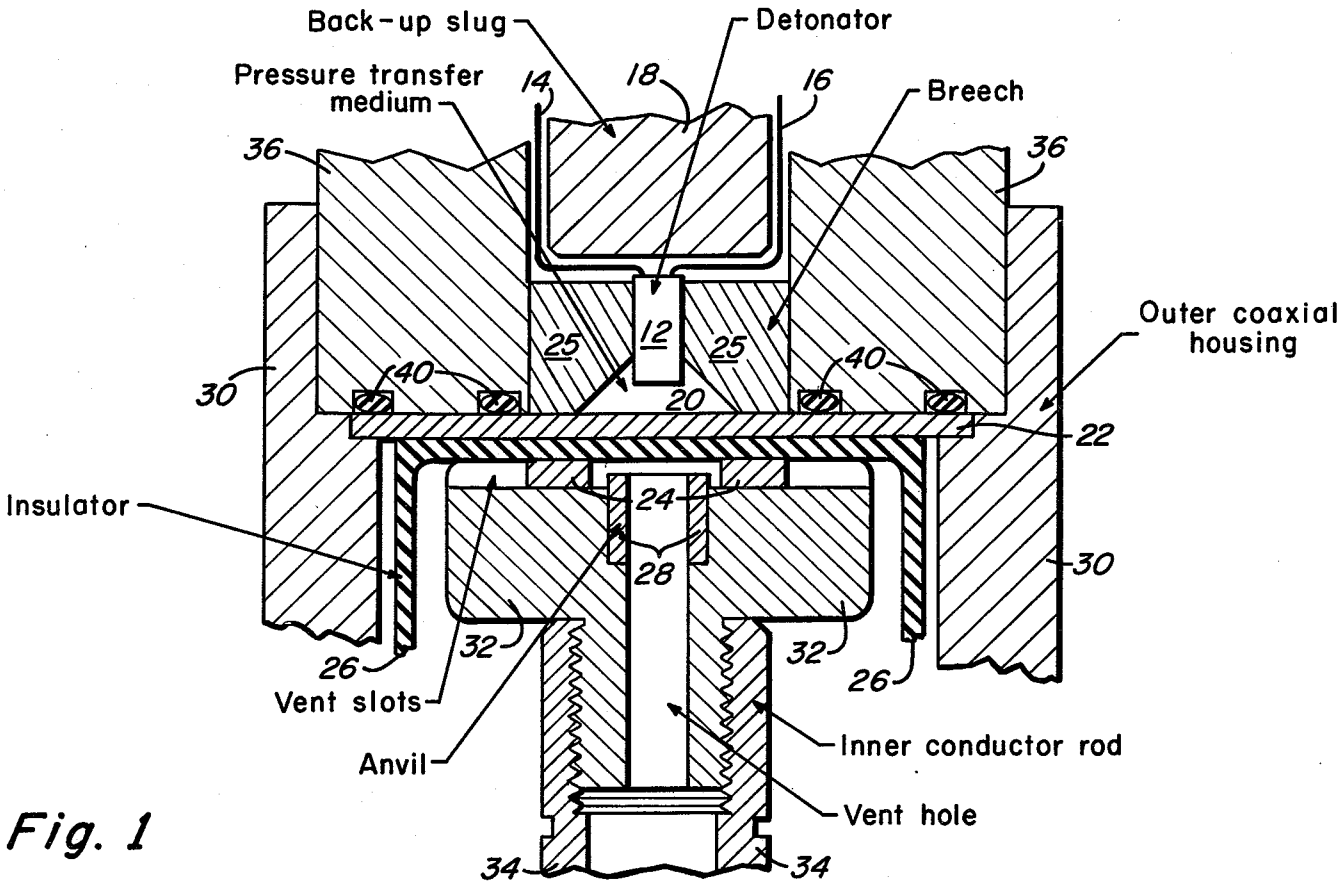
FIG. 1 shows a cutaway view of the switch of the invention.
Figure 2:
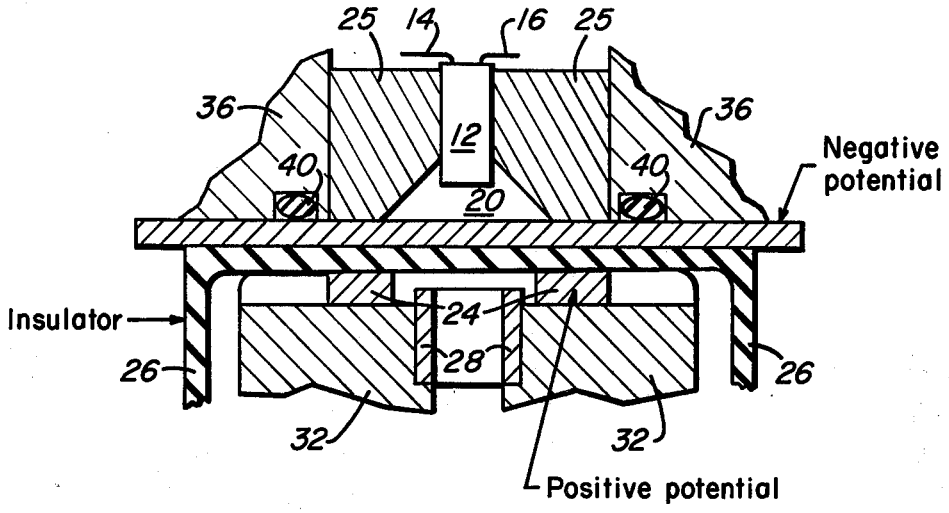
FIG. 2 shows a cutaway view of the part of the switch affected by the high-explosive before detonation.
Figure 3:
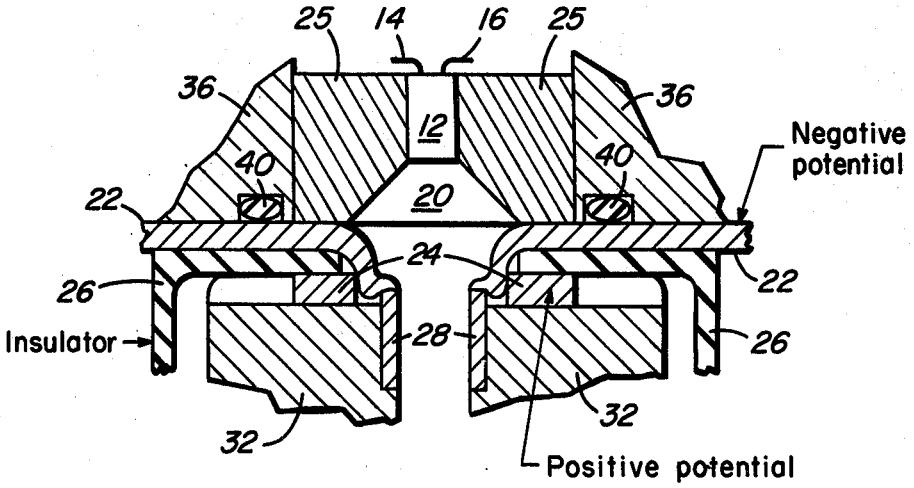
FIG. 3 shows the same portion of the switch as FIG. 2 after detonation of the high-explosive.

As seen in FIG. 1, a crowbar switch 10 comprises a detonator 12 having two leads 14 and 16, a steel backup slug 18, a pressure transfer medium comprising paraffin 20, and a conical void provided by a breech 25 between the detonator and the deformable conductor or driven plate 22. The conical walls established by breech 25 which may comprise a metal such as hardened steel contain the paraffin 20. In the preferred embodiment, supportive conductor or die plate 24 is in the shape of a washer, and preferably comprises 6061-T6 aluminum alloy. Although the supportive conductor 24 is replaced after every shot, its use performs a dual function. It not only "shapes" the deformation of the deformable conductor 22, it also acts as a suitable current joint edge. The "work piece" or deformable conductor 22 preferably comprises 1100-0 aluminum deformable by the expanding gases in such a manner that the supportive conductor 24 and the deformable conductor 22 are intimately forced together by detonation of the explosive 12. FIGS. 2 and 3 herein described show these components before and afer detonation. The rest of the device comprises a dielectric insulator 26 which electrically separates the deformable conductor 22 and the supportive conductor 24. A preferably annular anvil 28 for establishing a first arc contact and for stopping the edges of the deformable conductor 22, an outer coaxial housing 30, a vent hole through the anvil within a supportive structure 32, an inner conductor rod 34, a pressure containing chamber 36, and sealing O-rings 40 are also provided.

The explosive action occurs as follows: A detonator is assembled in the breech 25 with its open end extending within the conical void of breech 25. It is important that the front end of the detonator be actually embedded within the paraffin 20 to assure a coupling effect between the explosion and the paraffin. The rear of the detonator is closed off with steel back-up slug 18. This slug is appropriately slotted to provide passage for the wire leads 14 and 16, but it also prevents an excessive loss of explosive pressure out the back. When the detonator fires, the incident shock wave expands spherically through the transfer medium material. A uniform pressure front then exerts itself on the area of the deformable conductor 22 as limited by the base area of the conical taper section in breech 25. It is important to have a thick film of grease between the transmitting medium and the conductor 22 to more effectively couple the shock front and drive conductor 22. The O-ring 40, immediately outside this area, serves to contain the explosive force and prevent any lateral pressure loss.

As the uniform pressure wave hits the surface of conductor 22, a bending and extruding action takes place forcing the material thereof first into arc contact with and then against the anvil 28 to make initial current contact; then against the supportive conductor 24 where it becomes embedded in the annulus between annular supportive conductor 24 and the anvil 28. This action shears the dielectric insulator 26 and actually causes it to flow out of the way and ahead of the advancing metal of deformable conductor 22. The anvil 28 preferably comprises hardened steel, opened with a through-hole to provide essential venting of the die area and acting as a bumper which stops the material of conductor 22 in a restrictive fashion as shown in FIG. 3, after the initial current contact. The metal-to-metal contact caused by the explosion provides an extremely tight fit between the deformable conductor 22 and the supportive conductor 24, comparable perhaps to a "press fit" condition found between various machine elements. This contact completes the switching action between the positive and negative potential as shown in FIGS. 2 and 3.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

What we claim is:

1. An explosive driven low inductance crowbar switch comprising:

a deformable driven plate 22 at a first potential;

a die plate 24 for shaping the deformation of driven plate 22 and for supplying a current joint edge;

an insulation layer 26 disposed between said driven plate 22 and said die plate 24;

a conductive annular anvil 28 for establishing first arc contact with plate 22 and for stopping and establishing a press fit contact with said driven plate 22; and a detonator 12 and a pressure transfer medium 20 disposed adjacent driven plate 22 for selectively deforming a portion of said driven plate 22 and for driving said portion through insulation layer 26 first into arc contact with annular anvil 28, second into physical contact against anvil 28, and third into a press fit with die plate 24 and anvil 28.

2. The invention of claim 1 further comprising a layer of grease between pressure transfer medium 20 and driven plate 22.

* * * * *